US011284648B2

(12) United States Patent
Carlino et al.

(10) Patent No.: US 11,284,648 B2
(45) Date of Patent: Mar. 29, 2022

(54) YOUNG ADULT MODESTY SUPPORT GARMENT

(71) Applicant: NIKE, Inc., Beaverton, OR (US)

(72) Inventors: Shannan C. Carlino, Portland, OR (US); Iustinia Koshkaroff, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 6 days.

(21) Appl. No.: 16/439,370

(22) Filed: Jun. 12, 2019

(65) Prior Publication Data

US 2019/0387814 A1 Dec. 26, 2019

Related U.S. Application Data

(60) Provisional application No. 62/688,210, filed on Jun. 21, 2018.

(51) Int. Cl.

| | |
|---|---|
| ***A41C 3/00*** | (2006.01) |
| ***A41C 3/08*** | (2006.01) |
| ***A41C 3/14*** | (2006.01) |
| ***A41C 3/12*** | (2006.01) |

(52) U.S. Cl.

CPC ..... *A41C 3/0057* (2013.01); *A41C 3/08* (2013.01); *A41C 3/14* (2013.01); *A41C 3/128* (2013.01)

(58) Field of Classification Search

None

See application file for complete search history.

(56) References Cited

U.S. PATENT DOCUMENTS 2,061,739 A * 11/1936 Rasch ..... A41C 3/00 450/60
2,093,192 A * 9/1937 Fine ..... A41C 3/08 450/30
2,267,505 A * 12/1941 O'Bryan ..... A41C 3/08 2/73

(Continued)

OTHER PUBLICATIONS

International Search Report and Written Opinion dated Oct. 1, 2019 in International Patent Application No. PCT/US2019/038275, 15 pages.

(Continued)

*Primary Examiner* — Jocelyn Bravo

(74) *Attorney, Agent, or Firm* — Shook, Hardy & Bacon L.L.P.

(57) ABSTRACT

Aspects herein provide for a modesty support garment structure comprising varying layers of construction in different areas of the support garment. The modesty support garment comprises a breast contacting portion, an upper chest portion, a back portion, and a pair of shoulder straps. The upper chest portion is positioned superior to the breast contacting portion. The back portion is connected to the breast contacting portion by a pair of side portions, and the pair of shoulder straps extend from the upper chest portion to the back portion. The breast contacting portion comprises a three-layer construction comprising an outer layer, an inner layer, and a spacer mesh material positioned between the outer layer and the inner layer, which provides modesty to the breast contacting area. Additionally, the upper chest portion comprises a two-layer construction comprising an inner layer and an outer layer.

10 Claims, 4 Drawing Sheets

(56) References Cited

U.S. PATENT DOCUMENTS 2,482,255 A * 9/1949 Florsheim, Jr. ..... A41C 3/00 450/53
2,753,565 A * 7/1956 Holscher ..... A41C 3/10 450/72
2,797,415 A * 7/1957 Spanel ..... A41C 3/0014 450/39
3,021,844 A * 2/1962 Flagg ..... A41C 3/10 450/39
3,046,990 A * 7/1962 Dozier ..... A41C 3/00 450/36
3,070,870 A * 1/1963 Alexander ..... D04B 21/12 28/153
3,136,317 A * 6/1964 Freedman ..... A41C 3/10 450/54
3,225,768 A * 12/1965 Galitzki ..... A41C 3/0014 450/39
3,260,262 A * 7/1966 Enrico ..... A41C 3/0007 450/70
3,266,495 A * 8/1966 Sachs ..... A41C 3/10 450/55
3,500,665 A * 3/1970 Schoffner ..... D04B 11/06 66/176
3,506,014 A * 4/1970 Sorenson ..... A41C 3/0021 450/60
3,528,430 A * 9/1970 Elaine ..... A41C 3/0007 450/41
3,537,279 A * 11/1970 Epley ..... D04B 1/246 66/176
3,548,833 A * 12/1970 Lorraine ..... A41C 3/0021 450/60
3,568,670 A * 3/1971 Gaylord, Jr. ..... A61F 5/028 602/19
4,091,819 A * 5/1978 Huber ..... A41C 3/10 450/55
4,458,684 A * 7/1984 Frankel ..... A41C 3/00 450/53
4,607,640 A * 8/1986 McCusker ..... A41C 3/10 450/1
4,655,224 A * 4/1987 Stern ..... A41C 3/00 450/36
5,033,986 A * 7/1991 Feigenbaum ..... A41C 3/08 450/30
5,081,854 A * 1/1992 Lonati ..... A41C 3/0014 66/176
5,180,326 A * 1/1993 Williams ..... A41C 3/148 2/73
5,492,501 A * 2/1996 Brown ..... A41C 3/12 2/73
5,643,043 A * 7/1997 Pflum ..... A41C 3/0057 2/73
5,873,768 A * 2/1999 Fleischman-Ament ..... A41C 3/0057 2/73
6,083,080 A * 7/2000 Lawson ..... A41C 3/10 450/39
6,110,005 A * 8/2000 Stephenson ..... A41C 3/10 450/39
6,125,664 A * 10/2000 Browder, Jr. ..... A41C 3/0014 450/92
6,165,045 A * 12/2000 Miller ..... A41C 3/0057 450/1
6,192,717 B1 * 2/2001 Rabinowicz ..... D04B 1/243 66/171
6,213,841 B1 * 4/2001 Kuo ..... A41C 3/144 450/1
6,283,820 B1 * 9/2001 Huang ..... A41C 3/144 450/38
6,287,168 B1 * 9/2001 Rabinowicz ..... A41C 3/0007 450/156
6,306,006 B1 * 10/2001 Cheng ..... A41C 3/10 2/267
6,688,942 B2 * 2/2004 Holliday ..... A41C 3/0057 450/1
6,743,073 B1 * 6/2004 Tsai ..... A41C 3/144 2/1
6,837,771 B2 1/2005 Falla
6,846,217 B1 * 1/2005 Struble ..... A41C 3/08 2/78.1
7,214,120 B2 5/2007 Kaye et al.
7,275,977 B1 10/2007 Rhodes
7,381,113 B2 6/2008 Hori
7,407,427 B2 8/2008 Liu
7,438,625 B2 10/2008 Tremblay et al.
7,442,110 B2 * 10/2008 Gaudet ..... A41C 3/0057 450/39
7,455,567 B2 * 11/2008 Bentham ..... A41D 31/00 450/57
7,614,256 B2 * 11/2009 Mitchell ..... D04B 1/243 66/179
7,727,048 B2 * 6/2010 Gransberry ..... A41C 3/144 450/39
7,731,564 B2 * 6/2010 Sanders ..... A41C 3/0057 450/54
7,815,488 B2 * 10/2010 Gransberry ..... A41C 3/10 450/39
8,262,432 B2 9/2012 Sokolowski
8,439,721 B2 * 5/2013 Sokolowski ..... A41C 3/0014 450/41
8,465,341 B2 * 6/2013 Shashy ..... A41C 3/0057 450/39
8,480,452 B2 * 7/2013 Reinisch ..... A41C 3/0014 450/39
8,690,634 B2 * 4/2014 Heath ..... A41C 3/0057 450/41
8,777,693 B2 * 7/2014 Shashy ..... A41C 3/0057 450/66
8,808,056 B2 8/2014 Murphy et al.
8,915,764 B2 * 12/2014 Scott ..... A41C 3/12 450/53
8,925,114 B2 1/2015 Jackson et al.
9,210,955 B2 * 12/2015 Dandapure ..... A41C 3/12
9,241,514 B2 * 1/2016 Shearer ..... A41C 3/0057
9,320,305 B1 4/2016 Berger
9,345,272 B2 * 5/2016 Hurd ..... A41D 31/125
9,480,287 B2 * 11/2016 Black ..... A41F 15/007
9,603,392 B2 3/2017 Dandapure et al.
9,622,516 B2 * 4/2017 Lau ..... A41C 3/0014
9,788,579 B2 * 10/2017 Miller ..... A41C 3/0085
D821,699 S * 7/2018 Rendone ..... D2/706
10,104,918 B2 * 10/2018 Hurd ..... A41D 31/125
10,179,960 B2 * 1/2019 Diaz ..... D04B 1/108
10,231,492 B1 * 3/2019 Bastug ..... A41C 3/10
D854,784 S * 7/2019 Liu ..... D2/706
10,477,902 B1 * 11/2019 Blecha ..... A41C 3/0057
10,609,966 B2 * 4/2020 Huffa ..... A41C 3/124
10,660,377 B2 * 5/2020 Randall ..... A41C 3/0007
10,786,016 B2 * 9/2020 Caden ..... A61F 13/14
2002/0022433 A1 * 2/2002 Yeung ..... A41C 3/0057 450/70
2003/0181129 A1 * 9/2003 Getman ..... A41C 3/0057 450/57
2003/0232571 A1 * 12/2003 Weinerth ..... A41C 5/00 450/41
2004/0003629 A1 * 1/2004 Mitchell ..... A41C 5/00 66/179
2004/0014394 A1 * 1/2004 Mitchell ..... A41C 3/0014 450/65
2004/0224603 A1 * 11/2004 Kaye ..... A41C 3/10 450/1
2005/0075027 A1 * 4/2005 Etchells ..... B32B 5/147 442/205
2005/0204449 A1 * 9/2005 Baron ..... A41D 31/06 2/69
2005/0208860 A1 * 9/2005 Baron ..... A43B 1/14 442/414
2005/0255789 A1 * 11/2005 Gaudet ..... A41C 3/144 450/41
2006/0025043 A1 2/2006 Kawakami

(56) References Cited

U.S. PATENT DOCUMENTS

2006/0046614 A1* 3/2006 Hsu ..... A41C 3/0007 450/1
2006/0068155 A1* 3/2006 Rock ..... A41D 31/00 428/85
2006/0240743 A1* 10/2006 Mitchell ..... D04B 1/02 450/1
2006/0252346 A1* 11/2006 Reinisch ..... A41C 3/0028 450/86
2006/0265060 A1* 11/2006 Stelter ..... A61F 2/52 623/7
2007/0155283 A1* 7/2007 McQueer ..... A41D 13/0017 450/39
2008/0201818 A1* 8/2008 Nilforushan ..... A61F 7/02 2/69
2008/0209638 A1* 9/2008 Unger ..... D04B 21/02 5/636
2008/0280529 A1* 11/2008 Simpson ..... A41C 3/12 450/30
2009/0098803 A1* 4/2009 Reinisch ..... A41C 3/0014 450/39
2009/0130953 A1* 5/2009 Gransberry ..... A41C 3/10 450/39
2010/0005569 A1* 1/2010 Sanders ..... A41C 3/0057 2/400
2010/0240280 A1* 9/2010 Michel ..... A41B 9/00 450/39
2011/0143634 A1* 6/2011 Sokolowski ..... A41C 3/0057 450/39
2012/0122370 A1* 5/2012 Heath ..... A41C 3/0057 450/80
2012/0177904 A1* 7/2012 Gehring, Jr. ..... D04B 21/10 428/220
2012/0282844 A1* 11/2012 Salguero ..... A41B 9/06 450/31
2013/0065486 A1* 3/2013 Hansen ..... A41C 3/0064 450/59
2013/0255103 A1* 10/2013 Dua ..... B29C 66/244 36/87
2013/0316615 A1* 11/2013 Hurd ..... A41D 31/125 450/39
2014/0073222 A1* 3/2014 Turlan-Van Der Hoeven ..... A41C 3/12 450/57
2014/0080373 A1* 3/2014 Keitch ..... D04B 21/20 442/1
2014/0134922 A1* 5/2014 Hearty ..... A41F 15/00 450/31
2014/0343390 A1* 11/2014 Berzowska ..... A61B 5/01 600/388
2015/0056890 A1* 2/2015 Black ..... A41F 15/007 450/86
2015/0342267 A1 12/2015 Lau
2016/0044971 A1* 2/2016 Randall ..... A41C 3/0057 450/39
2016/0227845 A1* 8/2016 Hurd ..... A41C 3/12
2016/0338423 A1* 11/2016 Weber-Unger ..... A41C 3/0085
2016/0353810 A1* 12/2016 Barnes ..... A41C 3/0014
2017/0106622 A1* 4/2017 Bonin ..... B32B 5/06
2017/0332704 A1* 11/2017 Fontaine ..... A41D 7/00
2018/0000167 A1 1/2018 Miller et al.
2018/0187348 A1* 7/2018 Mueller ..... B60N 2/58
2018/0221648 A1* 8/2018 Gustavson ..... A41C 3/0064
2018/0242653 A1* 8/2018 Brandt ..... A41C 3/08
2018/0338563 A1* 11/2018 Moretti Polegato ... D04B 21/20
2019/0368087 A1* 12/2019 Boylu ..... D04B 21/207
2020/0085113 A1* 3/2020 Rendone ..... A41C 3/10
2020/0297042 A1* 9/2020 Carlino ..... A41C 5/00

OTHER PUBLICATIONS

"Glamorise Women's Full Figure Adjustable Wirefree Sport Bra #1166," Amazon, amazon.com, ASIN: B01E38TGY0, Oct. 12, 2011. https://www.amazon.com/gp/product/B01E38TGY0.

"Syrokan Women's High Impact Support Wirefree Workout Racerback Sports Bra Top," Amazon, amazon.com, ASIN: B01GCG0C08, May 30, 2016. https://www.amazon.com/gp/product/B01GCG0C08.

"Champion Women's Spot Comfort Full-Support Sport Bra," Amazon, amazon.com, ASIN: B004GXA71O, Item model No. 1602, Aug. 8, 2005. https://www.amazon.com/Champion-Womens-Comfort-Full-Support-Sport/dp/B004GXA71O.

"Medium Impact-Sports Bra," Forever 21, forever21.com, accessed: Apr. 2018. https://www.forever21.com/us/shop/catalog/product/f21/activewear/2000103989.

"Comfortisse Set of Three Double Layer Seamless Bras w/ Modesty Pads-000-510," evine, evine.com, May 25, 2017. https://web.archive.org/web/20170525191412/https://www.evine.com/Product/000-510.

International Preliminary Report on Patentability received for PCT Patent Application No. PCT/US2019/038275, dated Dec. 30, 2020, 8 pages.

* cited by examiner

YOUNG ADULT MODESTY SUPPORT GARMENT

CROSS-REFERENCE TO RELATED APPLICATIONS

This application, having U.S. Non-Provisional application Ser. No. 16/439,370 and entitled "Young Adult Modesty Support Garment," claims priority to U.S. Provisional Patent Application No. 62/688,210, filed on Jun. 21, 2018, and entitled, "Young Adult Modesty Support Garment," the entirety of which is incorporated herein by reference.

TECHNICAL FIELD

Aspects herein relate to a support garment configured to provide modesty and support a young adult's breasts.

BACKGROUND

Conventional support garments worn by young adults, including those configured to provide support during athletic activities, such as bras, may include features that make the support garment undesirable to young wearers. These features may include underwires, a tight underband, uncomfortable fabrics, and the like. Conventional support garments may also lack modesty features that are important to young wearers.

BRIEF DESCRIPTION OF THE DRAWINGS

Examples of the present invention are described in detail below with reference to the attached drawing figures, wherein.

DETAILED DESCRIPTION

Figure 1:
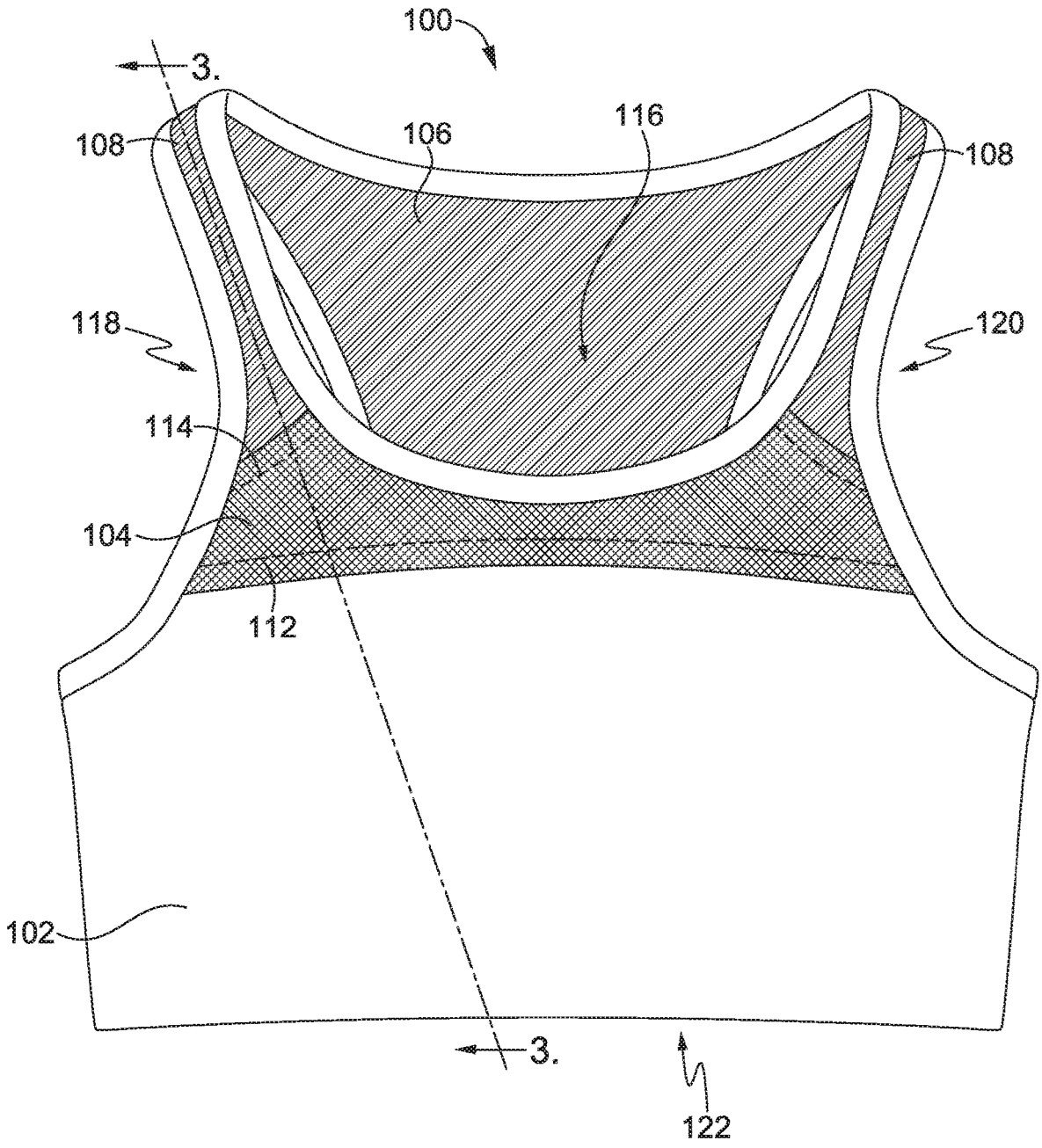
FIG. 1 illustrates a front view of an example modesty support garment, in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Generally, as young females begin to enter adolescence and puberty, they begin needing support garments, such as sport bras, during physical activity to support their growing breasts. However, often times the support garments available do not provide adequate modesty as the materials used to form the support garments may be thin in an effort to remain lightweight or breathable, resulting in the materials being at least partially transparent when worn. Additionally, some materials may become more transparent as the wearer sweats and the material of the support garment absorbs the perspiration. As such, by providing a support garment, such as a sport bra, for young adults with multiple layers of construction in different areas that provides improved modesty in the chest area, while remaining lightweight, breathable, and comfortable, young female adults have the opportunity to partake in physical activity and sports without the possibility of their breasts being visible through their sport bra.

At a high level, aspects herein relate to a modesty support garment, such as a bra, comprising varying layers of construction in different areas of the support garment. The modesty support garment comprises a breast contacting portion, an upper chest portion, a back portion, and a pair of shoulder straps. The upper chest portion is positioned superior to the breast contacting portion. The back portion is connected to the breast contacting portion by a pair of side portions, and the pair of shoulder straps extend from the upper chest portion to the back portion. The breast contacting portion comprises a three-layer construction having an outer layer, an inner layer, and a spacer mesh material positioned between the outer layer and the inner layer. The spacer mesh material provides modesty to the area by reducing any transparency in the breast contacting portion of the modesty support garment. Moreover, the thickness of the spacer mesh material helps to obscure features of the wearer's breasts. Additionally, the upper chest portion comprises a two-layer construction having an inner layer and an outer layer. The two layers of the upper chest portion allow for a turned-in seam that is positioned between the two layers making the modesty support garment more comfortable for the wearer. The back portion comprises a single layer construction. Additionally, the shoulder straps also comprise a single layer construction. The single layer construction in the back portion and shoulder straps of the modesty support garment comprises a mesh knit construction that allows for good air permeability and breathability and which further helps to keep the modesty support garment lightweight.

A further aspect of the present disclosure includes a method of manufacturing a modesty support garment. The method comprises providing a breast contacting panel comprising a three-layered construction having an inner layer, an outer layer, and a spacer mesh material positioned between the inner layer and the outer layer. An upper chest panel comprising a two-layer construction having an inner layer and an outer layer is also provided. Further, a back panel comprising a single layer construction and a pair of shoulder straps comprising a single layer construction are provided. Next, the back panel is secured to the breast contacting panel along the sides of the modesty support garment. Then, the upper chest panel is secured to the breast contacting panel so that the upper chest panel is positioned superior to the breast contacting panel. Finally, the shoulder straps are secured to the upper chest panel and the back panel so that the shoulder straps extend from the upper chest panel to the back panel.

Although the term "bra" and "support garment" are used herein, it is contemplated that the terms may apply to other types of support garments such as tank tops, camisoles with built-in support, swimming suit tops, body suits, and other styles or types of support garments used to support breast tissue. Example support garments may comprise bras as that term is known in the art (sport bras, conventional bras, and the like), camisoles, swimwear, or other garments with built-in support.

Additionally, positional terms as used herein to describe the modesty support garment such as "anterior," "posterior," "front," "back," "upper," "lower," "bottom," "inner-facing surface," "outer-facing surface," and the like are with respect to the garment being worn as intended and as shown and described herein by a wearer standing in an upright position.

Continuing, the term "terephthalate polymer" when describing, for example, a yarn means a yarn having filaments or fibers formed from terephthalate polymers and includes, for example, polyethylene terephthalate (PET). PET is a common thermoplastic polymer resin of the polyester family. In the context of textiles, PET is generally referred to by its common name, polyester. Additionally, the term "elastic yarn" or "elastomeric yarn" when describing, for example, a yarn generally means a yarn type that may provide a maximum stretch greater than about 200% under load prior to returning to its non-stretched state when the load is removed, and some elastomeric yarns provide a maximum stretch of about 400%. Examples of elastomeric yarn types include Spandex®, lycra, rubber, and the like.

Further, the term "spacer mesh" as used herein is meant to encompass both warp knit and weft knit spacer textiles as is known in the art of textiles. Spacer textiles are generally formed by utilizing at least one tie yarn to interknit first and second layers of the textile. More specifically, each of the first layer and the second layer may be knit separately, and the tie yarn(s) is used to connect the first layer and the second layer. For instance, the tie yarns may have "loop" portions that extend into each of the first layer and the second layer where the loop portions are interlooped with yarns in the first layer and the second layer to connect the two layers. The longitudinal length of the tie yarns is generally oriented perpendicular to the surface plane for the first and second layers. The end product generally provides superior durability, cushioning, breathability, and lightweight shape support.

The term "stitch line" as used herein generally refers to an area where two separate textile portions are joined together at their edges or adjacent to their edges by, for instance, stitching, bonding, welding, adhesives, and the like.

Figure 2:
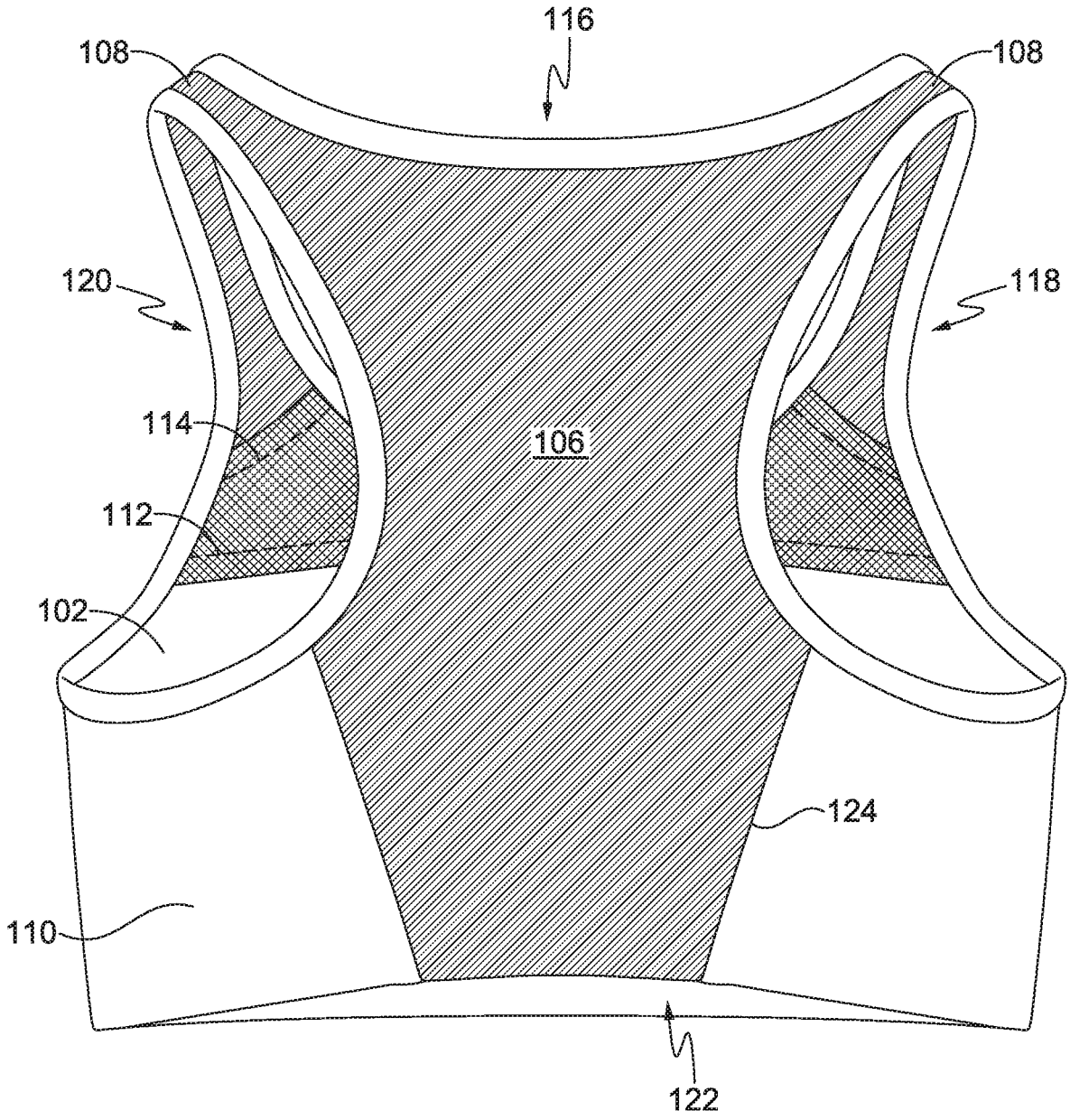
FIG. 2 illustrates a back view of the example modesty support garment of FIG. 1, in accordance with aspects herein.
Figure 3:
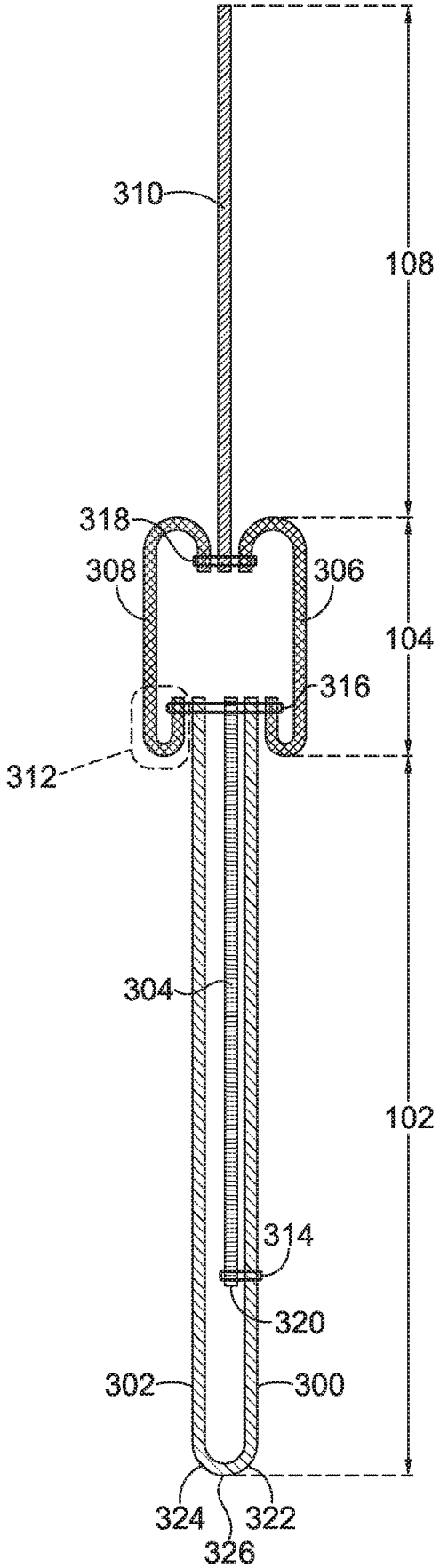
FIG. 3 illustrates a cross-section taken at cut line 3-3 of FIG. 1, in accordance with aspects herein.

Turning now to FIGS. 1-3, a front view of modesty support garment 100, a back view of the modesty support garment 100, and a cross section of the modesty support garment 100 taken at line 3-3 of FIG. 1 are illustrated, in accordance with aspects herein. In example aspects, the modesty support garment 100, shown in the form of a sport bra, comprises a breast contacting portion 102 configured to cover a wearer's right and left breasts, an upper chest portion 104 configured to cover an upper chest area of the wearer, a pair of shoulder straps 108 configured to extend over the wearer's shoulders, and a back portion 106 configured to at least partially cover the wearer's upper back torso. Additionally, as seen in FIGS. 1-2, the modesty support garment 100 includes a neck opening 116, a right arm opening 118, a left arm opening 120, and a torso opening 122.

As seen in FIGS. 1-2, the pair of shoulder straps 108 extend from the upper chest portion 104 to the back portion 106. Additionally, the upper chest portion 104 is positioned superior to the breast contacting portion 102. The upper chest portion 104 and the breast contacting portion 102 are secured to one another at stitch line 112. The upper chest portion 104 may be further secured to the shoulder straps 108 at stitch line 114. The back portion 106 is connected to the breast contacting portion 102 by a pair of side portions 110 (seen in FIG. 2) at stitch line 124. In one aspect, the different portions 102, 104, 106, 108, and 110 may comprise separate constructions that are joined together at one or more seam lines using affixing technologies such as stitching, bonding, welding, adhesives, and the like. In other aspects, the different portions 102, 104, 106, 108, and 110 may comprise integral extensions of one another. For instance, a knitting process may be used to seamlessly and integrally knit the different portions 102, 104, 106, 108, and 110 to form the modesty support garment 100. In yet another aspect, one or more of the portions 102, 104, 106, 108, and 110 may be seamlessly and integrally knit with another portion while remaining portions may comprise separate constructions that are joined to the integrally knit portions using affixing technologies described herein. Any and all aspects, and any variation thereof, are contemplated as being within aspects herein.

The breast contacting portion 102 of the modesty support garment 100 is configured to contact at least a wearer's breasts when the modesty support garment 100 is in an as-worn configuration. As seen in FIGS. 1-3, the back portion 106, the upper chest portion 104, and the breast contacting portion 102 are all are formed from different layered knit constructions. More specifically, as shown in FIG. 3, the breast contacting portion 102 comprises a three-layer construction. The breast contacting portion 102 comprises an inner layer 300, an outer layer 302, and a spacer mesh material 304 positioned between the inner layer 300 and the outer layer 302. As seen in FIG. 3, in one example aspect, the inner layer 300 and the outer layer 302 may comprise a single textile that is folded at the bottom margin of the modesty support garment 100 as indicated by reference numeral 326. It is also contemplated herein, that the inner layer 300 and the outer layer 302 may comprise separate textiles that are joined together at a seam at the bottom margin 326 of the modesty support garment 100.

Continuing, with further respect to FIG. 3, the spacer mesh material 304 is secured to the inner layer 300 of the breast contacting portion 102 as shown by the stitch 314. Alternatively, the spacer mesh material 304 may be secured to the outer layer 302 or secured to both the inner layer 300 and the outer layer 302 of the breast contacting portion 102. The spacer mesh material 304 is contemplated to have a thickness from about 2 to about 10 millimeters, from about 4 to about 8 millimeters thick, or from about 5 to about 7.3 millimeters thick. The term "about" as used herein means within ±10% of a designated value. This range of thickness of the spacer mesh material 304 provides for increase modesty in the breast contacting portion 102 while still remaining thin enough so that the breast contacting portion 102 is lightweight, breathable, and comfortable for the wearer.

The inner layer 300 and the outer layer 302 of the breast contacting portion 102 may be formed from polyester yarns and elastic yarns. The use of polyester yarns, with their low moisture regain, may facilitate the movement of moisture or perspiration away from a skin surface of a wearer to an outer-facing surface of the modesty support garment 100 where the moisture or perspiration may evaporate. And the use of elastic yarns may allow for a degree of stretch which may be important when donning and doffing the modesty support garment 100 and/or to provide a level of support. Further, the inner layer 300 and the outer layer 302 of the breast contacting portion 102 may be formed from a napped textile. As used herein, a napped textile results from a finishing process in which fibers of the textile are raised to produce a mat of fiber ends or nap. When napped, the loose staple fibers are removed from the textile structure, making the fabric feel softer. As such, the breast contacting portion 102 that is formed from a napped textile results in a softer feeling textile that is more comfortable for the wearer when in contact with the wearer's skin.

Next, the upper chest portion 104 comprises a two-layer construction comprising an inner layer 306 and an outer layer 308 as shown in FIG. 3. The inner layer 306 and the outer layer 308 are formed from polyester yarns and elastic yarns and may comprise a mesh knit construction. As used herein, the term mesh knit construction means a loosely knitted fabric that has a large number of closely spaced holes. Use of a mesh knit construction facilitates the passage of air through the layer(s) which, in turn, may promote evaporation of perspiration and contribute to wearer comfort. As seen in FIG. 1, the upper chest portion 104 is secured to both the breast contacting portion 102 at stitch line 112 and to the shoulder straps 108 at stitch line 114. As previously mentioned, the upper chest portion 104 may be secured to the breast contacting portion 102 and the shoulder straps 108 by stitching, bonding, or any other affixing technology.

Additionally, as seen in FIG. 3, a turned-in seam 312 is formed between the breast contacting portion 102 and the upper chest portion 104 and also between the upper chest portion 104 and the shoulder straps 108. More specifically, the outer layer 308 of the upper chest portion 104 is secured to the outer layer 302 of the breast contacting portion 102 using a turned-in seam 312, the inner layer 306 of the upper chest portion 104 is secured to the inner layer 300 of the breast contacting portion 102 using a turned-in seam 312, the outer layer 308 of the upper chest portion 104 is secured to the single layer mesh knit construction 310 of the shoulder straps 108 using a turned-in seam 312, and the inner layer 306 of the upper chest portion 104 is secured to the single layer mesh knit construction 310 of the shoulder straps 108 using a turned-in seam 312. FIG. 3 depicts the turned-in seam 312 of the upper chest portion 104 that are secured to the breast contacting portion 102 and shoulder straps 108 by stitches 316 and 318. The term "turned-in seam" as used herein means a seam formed between two or more separate pieces of material, where the fabric ends of the different materials are oriented in the same direction, and the fabric ends are secured together in a space formed between, for instance, an inner and an outer layer of material. Although the turned-in seam 312 is depicted as below the stitch line 112 in FIG. 1, it is contemplated the turned-in seam 312 could be above the stitch line 112 as well. The turned-in seam 312 makes the modesty support garment 100 more comfortable for the wearer as the turned-in seam 312 is positioned between the inner layer 306 and the outer layer 308. This is in contrast to other seam types such as bound seams, super-imposed seams, flat seams, and the like, which may irritate the skin of the wearer when the seam contacts the wearer's skin surface.

In some example aspects, it is contemplated herein that the modesty support garment 100 may not comprise the upper chest portion 104. In this aspect, the three-layered construction of the breast contacting portion 102 would transition to the single-layered construction of the shoulder straps 108.

Next, the shoulder straps 108 of the modesty support garment 100 are configured to extend over the shoulder areas of the wearer when the modesty support garment 100 is in the as-worn configuration. In example aspects, the shoulder straps 108 may be optional. For example, the modesty support garment 100 may be constructed as a bandeau-style garment. When used, the shoulder straps 108 also help to connect the upper chest portion 104 to the back portion 106. More particularly, in example aspects, the shoulder straps 108 may be affixed to the upper chest portion 104 at stitch line 114 by stitching, bonding, or any affixing technique. Any and all aspects, and any variation thereof, are contemplated as being within aspects herein.

The shoulder straps 108 of the modesty support garment 100 may be formed from a single layer mesh knit construction 310. The single layer mesh knit construction 310 of the shoulder straps 108 is formed from polyester yarns and elastic yarns. However, in other aspects, it is contemplated that other yarn types may be used.

Continuing, the back portion 106 seen in FIGS. 1 and 2, is configured to contact at least a portion of the wearer's back torso when the modesty support garment 100 is in the as-worn configuration. FIG. 2 depicts a back view of the modesty support garment 100, showing the back portion 106 which comprises a single layer construction (not shown in FIG. 3). Additionally, as seen in FIG. 2, the back portion 106 is secured to the breast contacting portion 102 along the side portions 110 of the modesty support garment 100 at 124. As shown in FIG. 2, the back portion of the modesty support garment 100 is configured as a racerback-style. However, in other aspects, the back portion 106 of the modesty support garment 100 may be configured as a conventional style. Any and all aspects, and any variation thereof, are contemplated as being within aspects herein.

The back portion 106 of the modesty support garment 100 may be formed form a single layer mesh knit construction similar to the shoulder straps 108. The single layer mesh knit construction may include polyester and elastic yarns. The construction of the back portion 106 provides breathability and air permeability to the modesty support garment 100 and also helps to make the modesty support garment 100 lightweight. The use of other types of yarns for the back portion 106 are also contemplated, and any and all aspects and any variations therefore, are contemplated as being within aspects herein.

In some aspects, as seen in FIG. 3, a bottom edge 320 of the spacer mesh material 304 may be spaced apart from a bottom edge 322 of the inner layer 300 and a bottom edge 324 of the outer layer 302 of the breast contacting portion 102. In example aspects, the space between the bottom edge 320 of the spacer mesh material 304 and the bottom edges 322 and 324 of the inner layer 300 and outer layer 302 may serve as the "underband" of the modesty support garment 100. In contrast to more typical support garment constructions, this area does not include any type of elastic band that may cause unnecessary constriction and be uncomfortable to young adult wearers.

Figure 4:
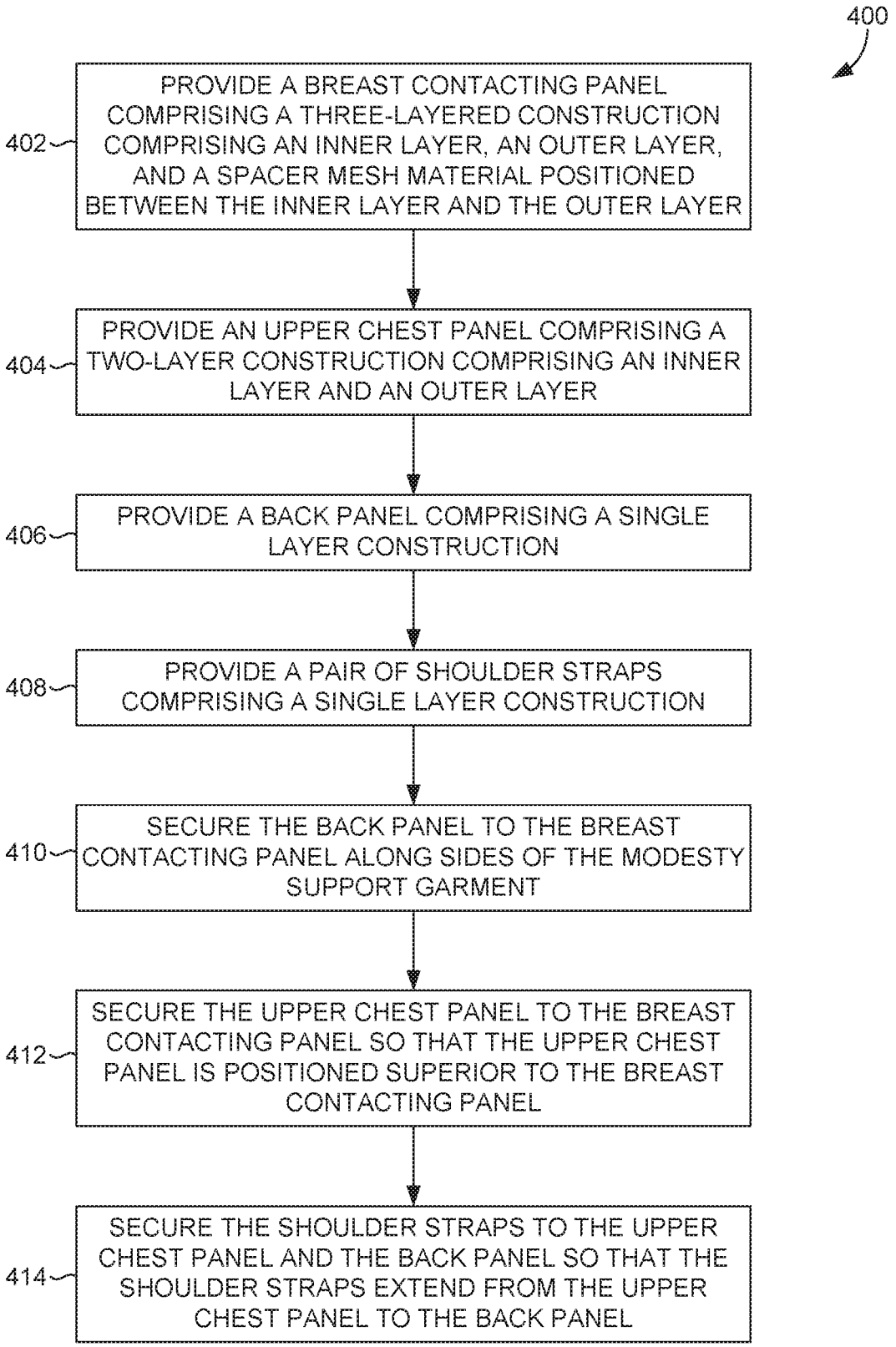
FIG. 4 depicts a flow diagram illustrating an example method for manufacturing an example modesty support garment, in accordance with aspects herein.

Next, FIG. 4 describes an example method 400 for manufacturing a modesty support garment, such as the modesty support garment 100, in accordance with aspects herein. Beginning with step 402, a breast contacting panel comprising a three-layered construction is provided. As previously mentioned, the three-layered construction comprises an inner layer, an outer layer, and a spacer mesh material that is positioned between the inner layer and the outer layer of the breast contacting portion. Next, at 404, an upper chest panel comprising a two layer construction comprising an outer layer and an inner layer is provided. Then, at 406, a back panel comprising a single layer construction is provided. Additionally, a pair of shoulder straps comprising a single layer construction are also provided at 408.

The modesty support garment is formed by securing the panels provided at steps 402-408 together. More specifically, the back panel is secured to the breast contacting panel along the sides of the modesty support garment at step 410. Additionally, the upper chest panel is secured to the breast contacting panel so that the upper chest panel is positioned superior to the breast contacting panel at 412. Finally, the shoulder straps are secured to the upper chest panel and the back panel so that the shoulder straps extend from the upper chest panel to the back panel at 414.

In example aspects, the outer and inner layers of the breast contacting panel may undergo a napping process as previously described herein. Additionally, as previously mentioned, the spacer mesh material is secured to the inner layer of the breast contacting panel and may be secured by one or more stitch lines. This construction provides a clean aesthetic to the front of the modesty support garment. The spacer mesh material may also be bonded or secured to the inner layer of the breast contacting panel via any other affixing technique. Further, when the upper chest panel is secured to the breast contacting panel and to the shoulder straps, turned-in seams are formed, providing comfort to the wearer at the location where the upper chest portion is secured to the shoulder straps and the location where the upper chest portion is secured to the breast contacting panel contact the wearer's skin.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

What is claimed is:

1. A modesty support garment comprising:

a breast contacting portion;

an upper chest portion comprising a two-layer construction comprising an inner layer and an outer layer and positioned superior to the breast contacting portion;

a back portion comprising a single layer mesh knit construction and connected to the breast contacting portion by a pair of side portions; and a pair of shoulder straps comprising a single layer mesh knit construction extending from the upper chest portion to the back portion, wherein the breast contacting portion comprises a three-layer knit construction comprising an inner layer made of a napped textile, an outer layer made of a napped textile, and a spacer mesh material positioned between the inner layer and the outer layer and secured to the inner layer of the breast contacting portion at a first stitch line, wherein the inner layer and the outer layer of the breast contacting portion are formed from a single textile that is folded at a bottom margin of the modesty support garment such that bottom portions of the inner layer and the outer layer of the breast contacting portion located along the bottom margin together function as an underband of the modesty support garment, and the modesty support garment does not include any additional elastic bands along the bottom margin of the modesty support garment, and wherein the spacer mesh material is spaced apart from a bottom most extent of the inner layer of the breast contacting portion and a bottom most extent of the outer layer of the breast contacting portion, such that the bottom portion of the inner layer of the breast contacting portion is located directly adjacent to the bottom portion of the outer layer of the breast contacting portion, without the spacer mesh material extending between the respective bottom portions; and wherein the inner layer and the outer layer of the upper chest portion are secured to the breast contacting portion at a second stitch line and to the shoulder straps at a third stitch line.

2. The modesty support garment of claim 1, wherein the single layer mesh knit construction of the back portion is formed from polyester yarns and elastic yarns.

3. The modesty support garment of claim 1, wherein a thickness of the spacer mesh material is from about 2 millimeters to about 10 millimeters.

4. The modesty support garment of claim 1, wherein the inner layer and the outer layer of the breast contacting portion are each formed from polyester yarns and elastic yarns.

5. The modesty support garment of claim 1, wherein the second stitch line comprises a turned-in seam that is formed between the breast contacting portion and the upper chest portion.

6. The modesty support garment of claim 1, wherein the third stitch line comprises a turned-in seam that is formed between the upper chest portion and the pair of shoulder straps.

7. The modesty support garment of claim 1, wherein the single layer mesh knit construction of the pair of shoulder straps is formed from polyester yarns and elastic yarns.

8. The modesty support garment of claim 1, wherein the outer layer and the inner layer of the upper chest portion are each formed from polyester yarns and elastic yarns.

9. A method for manufacturing a modesty support garment comprising:

providing a breast contacting panel comprising a three-layered construction having an inner layer made of a napped textile, an outer layer made of a napped textile, and a spacer mesh material positioned between the inner layer and the outer layer and secured to the inner layer of the breast contacting panel at a first stitch line, wherein the inner layer and the outer layer comprise a single textile folded at a bottom margin of the modesty support garment such that bottom portions of the inner layer and the outer layer located along the bottom margin together function as an underband of the modesty support garment, and the modesty support garment does not include any additional elastic bands along the bottom margin of the modesty support garment, and wherein the spacer mesh material is spaced apart from a bottom most extent of the inner layer and a bottom most extent of the outer layer, such that the bottom portion of the inner layer is located directly adjacent to the bottom portion of the outer layer, without the spacer mesh material extending between the respective bottom portions;

providing an upper chest panel comprising a two-layer construction having an inner layer and an outer layer;

providing a back panel comprising a single layer mesh knit construction;

providing a pair of shoulder straps comprising a single layer mesh knit construction;

providing a pair of side panels;

securing the back panel to the breast contacting panel via the pair of side panels along sides of the modesty support garment;

securing the upper chest panel to the breast contacting panel at a second stitch line so that the upper chest panel is positioned superior to the breast contacting panel; and securing the pair of shoulder straps to the upper chest panel at a third stitch line and to the back panel so that the pair of shoulder straps extend from the upper chest panel to the back panel.

10. The method of claim 9, wherein each of the second stitch line and the third stitch line comprises a turned-in seam.

* * * * *